US008229328B2

(12) United States Patent
Yamamoto

(10) Patent No.: US 8,229,328 B2
(45) Date of Patent: Jul. 24, 2012

(54) DEVELOPER SUPPLY MECHANISM, DEVELOPMENT APPARATUS AND IMAGE FORMING APPARATUS HAVING THE DEVELOPER SUPPLY MECHANISM

(75) Inventor: Koju Yamamoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 324 days.

(21) Appl. No.: 12/729,621

(22) Filed: Mar. 23, 2010

(65) Prior Publication Data

US 2010/0272475 A1 Oct. 28, 2010

(30) Foreign Application Priority Data

Apr. 27, 2009 (JP) ..... 2009-107297

(51) Int. Cl.
*G03G 15/08* (2006.01)

(52) U.S. Cl. ..... 399/258; 399/119

(58) Field of Classification Search ..... 399/258, 399/119

See application file for complete search history.

(56) References Cited

U.S. PATENT DOCUMENTS 5,128,724 A * 7/1992 Hayashi et al. ..... 399/119
5,537,191 A * 7/1996 Aruga et al. ..... 399/254
5,778,296 A * 7/1998 van der Steen et al. ..... 399/360
5,933,696 A * 8/1999 Howard et al. ..... 399/360
2004/0096242 A1* 5/2004 Murakami ..... 399/258
2006/0093401 A1* 5/2006 Tanda ..... 399/227
2008/0253804 A1* 10/2008 Furuta et al. ..... 399/119

FOREIGN PATENT DOCUMENTS

JP 6-67539 3/1994

* cited by examiner

*Primary Examiner* — David Gray
*Assistant Examiner* — G. M. Hyder
(74) *Attorney, Agent, or Firm* — Smith, Gambrell & Russell, LLP

(57) ABSTRACT

A developer supply mechanism is composed of: a developer supply path one end side of which is opened upward and which guides the developer in substantially a vertical direction; a convex portion that is formed on a wall surface of the developer supply path; a coil spring that is disposed in the developer supply path, stretchable and shrinkable in a longitudinal direction of the developer supply path, pressurized to the convex portion in a natural-length state, stretched toward one end side of the developer supply path when the convex portion is hooked on between pitches by a circumferential-direction rotation, and is given a horizontal-direction movement to leave the convex portion when coming off the convex portion; and a drive portion that is connected to the coil spring at the other end side of the developer supply path and rotates the coil spring in a circumferential direction of the coil spring.

10 Claims, 7 Drawing Sheets

DEVELOPER SUPPLY MECHANISM, DEVELOPMENT APPARATUS AND IMAGE FORMING APPARATUS HAVING THE DEVELOPER SUPPLY MECHANISM

BACKGROUND OF THE INVENTION

This application is based on Japanese Patent Application No. 2009-107297 filed on Apr. 27, 2009, the contents of which are hereby incorporated by reference.

FIELD OF THE INVENTION

The present invention relates to a developer supply mechanism that supplies developer to a development apparatus of an image forming apparatus such as a copy machine, a printer, a facsimile machine and the like.

DESCRIPTION OF RELATED ART

In a development apparatus, a remaining amount sensor that detects the amount of remaining developer is disposed. For example, if it is detected by the remaining amount sensor that the amount of developer in the development apparatus is less than a predetermined value, developer is supplied from a toner container to the development apparatus. In an image forming apparatus that is going smaller in recent years, in consideration of a layout of each apparatus, in many cases, a structure is employed, in which developer that is sent out from a toner container is supplied to a development apparatus via a developer supply path.

Here, developer that is carried, for example, toner has fluidity that is necessary for carry in principle. However, under a condition such as high temperature and high humidity, toner easily adheres to each other to form a toner lump. And, this toner lump adversely affects the carry of toner and raises a problem that stable tone supply to a development apparatus is impeded.

To solve such problem, a proposition is disclosed in JP-A-1994-67539, for example, in which a toner lump that is carried is broken down in a toner supply apparatus which carries toner in a horizontal direction.

FIG. 8 is a diagram showing a toner supply apparatus 101 described in JPA-1994-67539. In this toner supply apparatus 101, a carry spring spiral 102 that is stretchable and shrinkable in a longitudinal direction is energized at the other end side 103*a* of the inside of a toner carry path 103 that is horizontally elongate and disposed horizontally and rotatably supported at one end side (not shown) of the toner carry path 103.

A step 104 is formed at the other end side 103*a* of the inside of the toner carry path 103; when the carry spring spiral 102 rotates, the carry spring spiral 102 stretches and shrinks in the longitudinal direction. A toner lump is carried from the one end side to the other end side 103*a* in the horizontal direction by the carry spring spiral 102 and broken down by stretch and shrinkage of the carry spring spiral 102.

SUMMARY OF THE INVENTION

The present invention has been made to deal with the conventional problems, and it is an object of the present invention to provide a toner carry mechanism that allows stable toner carry by introducing a mechanism that positively breaks down toner even in a carry path where toner moves substantially vertically.

To achieve the above object, a developer supply mechanism according to an aspect of the present invention is structured to include: a developer supply path one end side of which is opened upward and which guides the developer in substantially a vertical direction; a convex portion that is formed on a wall surface of the developer supply path; a coil spring that is disposed in the developer supply path, stretchable and shrinkable in a longitudinal direction of the developer supply path, pressurized to the convex portion in a natural-length state, stretched toward one end side of the developer supply path when the convex portion is hooked on between pitches by a circumferential-direction rotation, and is given a horizontal-direction movement to leave the convex portion when coming off the convex portion; and a drive portion that is connected to the coil spring at the other end side of the developer supply path and rotates the coil spring in the circumferential direction of the coil spring.

Still other objects of the present invention and specific advantages obtained by the present invention are made more apparent from description of the embodiments described below.

DETAILED DESCRIPTION OF THE PREFERRED EMBODIMENTS

Hereinafter, the embodiments of the present invention are described based on the drawings.

Figure 1:
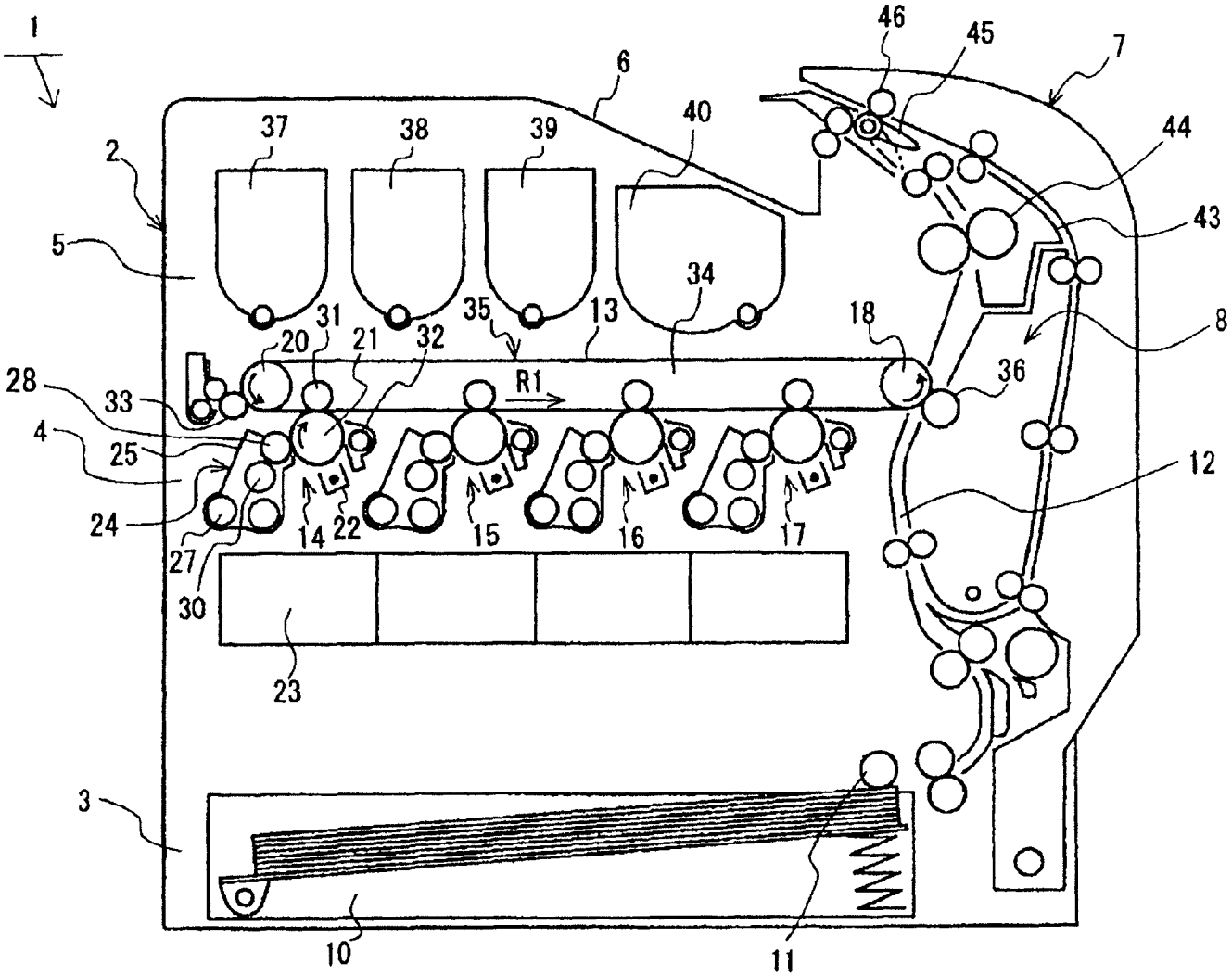
FIG. 1 is a diagram schematically showing an internal structure of an image forming apparatus according to an embodiment of the present invention.

With reference to FIG. 1, an internal structure of an image forming apparatus 1 according to an embodiment of the present invention is described. As shown in FIG. 1, in order from a bottom side to a top side of an image-forming-apparatus main body 2, the image forming apparatus 1 according to the embodiment of the present invention is equipped with: a sheet storage portion 3; an image forming portion 4; a toner supply portion 5; a paper sheet ejection tray 6. Besides, a sheet carry portion 8 is disposed between a front side of the image-forming-apparatus main body 2 and a front cover 7. A sheet supply cassette 10 is disposed in the sheet storage portion 3. The sheet supply cassette 10 sends out a sheet of a plurality of sheets (recording paper sheets) loaded inside to a sheet carry path 12 by using a sheet supply means 11. The image forming portion 4 is disposed over the sheet storage portion 3.

In the image forming portion 4, an intermediate transfer belt 13 and four (four colors) image forming stations that are arranged along a rotation direction (arrow R1 direction) of the intermediate transfer belt 13, that is, image forming stations 14, 15, 16 and 17 that form magenta (M), cyan (C), yellow (Y) and black (B) toner images, respectively are disposed. Here, because the four color image forming stations 14 to 17 have the same structure, the magenta image forming station is described below and description of the other three color image forming stations 15 to 17 is skipped.

The intermediate transfer belt 13 is formed into an endless shape and mounted between a drive roller 18 and a driven roller 20. The intermediate transfer belt 13 rotates in the arrow direction R1 together with the arrow-direction rotation of the drive roller 18.

The magenta-image forming station 14 includes: a photoreceptor drum (image carrier) 21; and an electrification device 22, an exposure device 23, a development apparatus 24, a primary transfer roller 31, a drum cleaner 32 and the like that are disposed substantially in order around the photoreceptor drum 21 in a rotation direction (arrow direction) of the photoreceptor drum 21.

The photoreceptor drum 21 is driven to rotate in the arrow direction at a predetermined process speed. In the present embodiment, as the photoreceptor drum 21, an a-Si (amorphous silicon) photoreceptor drum is used.

The electrification device 22 evenly (constantly) electrifies a surface of the photoreceptor drum 21 at a predetermined polarity and potential.

The exposure device 23 guides laser light emitted from a laser oscillator (not shown) to the surface of the photoreceptor drum 21 after the even electrification. And, the electric charges on electrified portions of the surface of the photoreceptor drum 21 are removed by the exposure to the laser light and an electrostatic latent image is formed.

The development apparatus 24 develops the electrostatic latent image formed on the surface of the photoreceptor drum 21. The development apparatus 24 includes: a developer supply mechanism 25 (see FIG. 4B) described later that supplies developer to the development apparatus 24; a housing 26 that stores the supplied developer and the like; a developer stir and carry spiral 27 that stirs and carries the developer; a development roller 28; and a developer supply roller 30 that transports the stirred and carried developer the development roller 28, and these constitute the development apparatus 24 as a whole.

A development bias is applied across the development roller 28 and the photoreceptor drum 21, so that the developer carried on the surface of the development roller 28 is made adhere selectively to the electrostatic latent image on the surface of the photoreceptor drum 21 to develop the electrostatic latent image.

The primary transfer roller 31 (transfer means) transfers the toner image formed on the surface of the photoreceptor drum 21 to the intermediate transfer belt 13. The primary transfer roller 31 pressurizes a rear-surface side of the intermediate transfer belt 13 to make the surface of the intermediate transfer belt 13 come into contact with the surface of the photoreceptor drum 21. According to this, a primary transfer nip is formed between the surface of the intermediate transfer belt 13 and the surface of the photoreceptor drum 21. The toner image formed on the photoreceptor drum 21 is carried to the primary transfer nip as the photoreceptor drum 21 rotates in the arrow direction. Here, a primary transfer bias is applied to the primary transfer roller 31, so that the magenta toner image on the surface of the photoreceptor drum 21 is primary-transferred to the surface of the intermediate transfer belt 13. Here, in the present embodiment, the intermediate transfer belt 13, the drive roller 18, the driven roller 20, the four primary transfer rollers 31, and the belt cleaner 33 are collectively built in a transfer frame 34 to constitute an intermediate transfer unit 35.

The drum cleaner 32, in the above primary transfer, removes toner (primary transfer remaining toner) that is not transferred to the intermediate transfer belt 13 and remains on the surface of the photoreceptor drum 21. Here, in the present embodiment, the photoreceptor drum 21, the electrification device 22, the drum cleaner 32 and the like are collectively disposed to constitute a drum unit.

As described above, in the magenta-image forming station 14, the magenta toner image formed on the surface of the photoreceptor drum 21 is transferred to the surface of the intermediate transfer belt 13. In the image forming stations 15, 16 and 17 for the other three colors (cyan, yellow and black) as well, likewise, cyan, yellow and black toner images are formed on the photoreceptor drums 21, respectively; these toner images are successively transferred to the intermediate transfer belt 13 by the primary transfer roller 31 to be overlapped. As described later, a secondary transfer bias is applied to a secondary transfer roller 36, so that these four color toner images are secondary-transferred onto a sheet at a time in a secondary transfer nip. Toner that remains on the surface of the intermediate transfer belt 13 after the secondary transfer of the toner image is removed by the belt cleaner 33 that is disposed in the vicinity of the driven roller 20. The toner supply portion 5 is disposed over the image forming portion 4.

In the toner supply portion 5, four toner containers that separately store each color toner, that is, toner containers 37, 38, 39 and 40 for magenta, cyan, yellow and black are disposed. In the development apparatus 24 for each of the above color toner containers 37 to 40, a remaining amount sensor (not shown) for detecting the amount of remaining developer is disposed; when this remaining amount sensor detects that the amount of developer in the development apparatus 24 becomes less than a predetermined value, toner is supplied from each of the color toner containers 37 to 40 to each-color development apparatus 24. The above paper sheet ejection tray 6 that is freely opened and closed about the rear-end side is disposed above the toner supply portion 5.

The sheet carry portion 8 is, in the present embodiment, disposed between the front side of the image-forming-apparatus main body 2 and the front cover 7 and includes: the sheet carry path 12 that guides a sheet which advances from a downstream position to an upstream position; and a sheet carry path 43 that is formed in front of the sheet carry path 12 and guides a sheet which advances from an upstream position to a downstream position. A fixing device 44 is disposed at a more downstream position than the secondary transfer position in the sheet carry direction, and the sheet carry path 12 guides a sheet on which a toner image is fixed by the fixing portion 44 to the paper sheet ejection tray 6 or to the sheet carry path 43 (sheet carry-back path for both-surface print). Besides, as for the sheet carry path 43, in a case where both-surface printing is performed, a sheet that is carried in the sheet carry path 12 is guided by a flapper 45 and a rear end of the sheet is held by a reverse roller 46; thereafter, the sheet is carried from an upstream position to a downstream position by the reverse roller 46, so that the sheet is guided to the sheet carry path 43.

(Developer Supply Mechanism)

Figure 2:
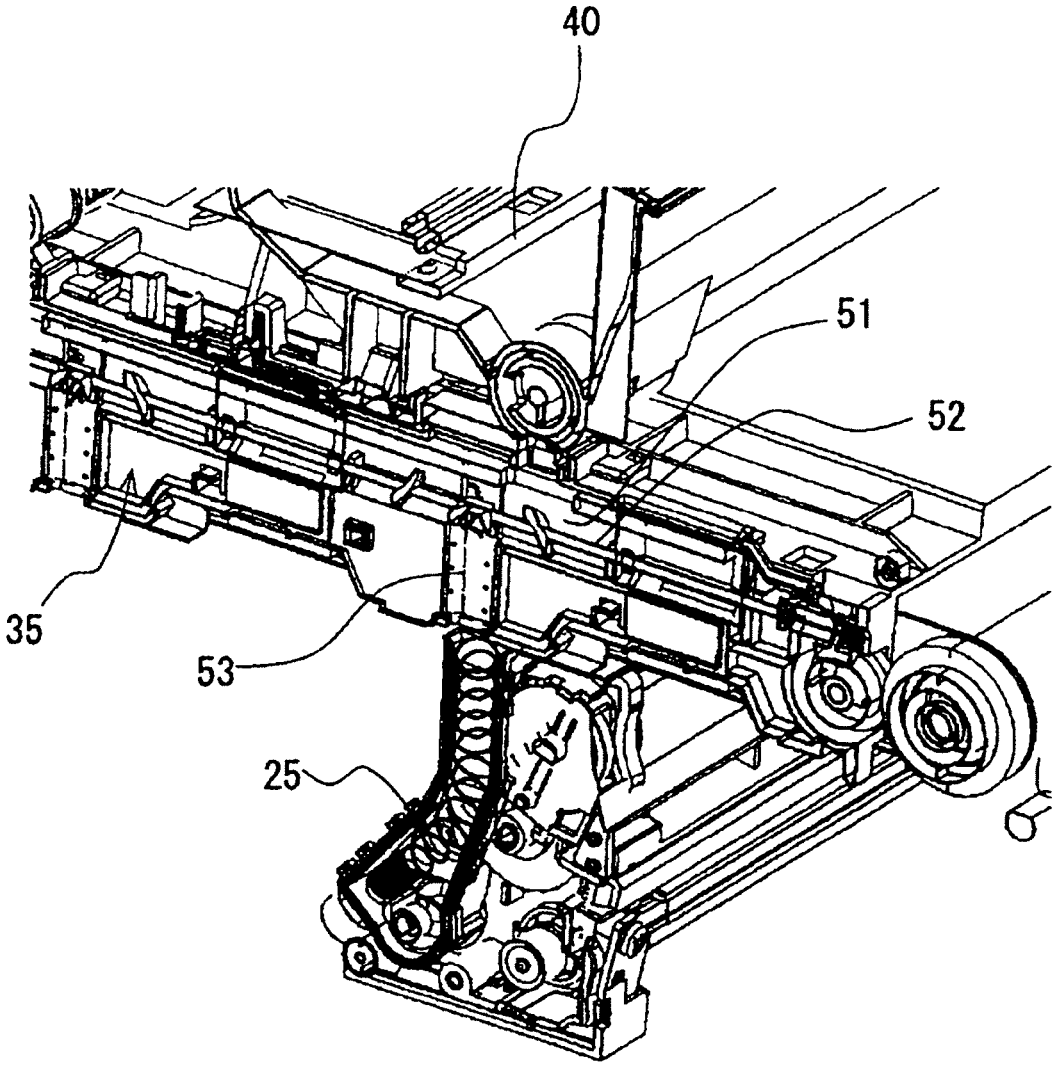
FIG. 2 is a diagram showing a carry path in which developer is carried from a toner container according to an embodiment of the present invention to a developer supply mechanism.
Figure 3:
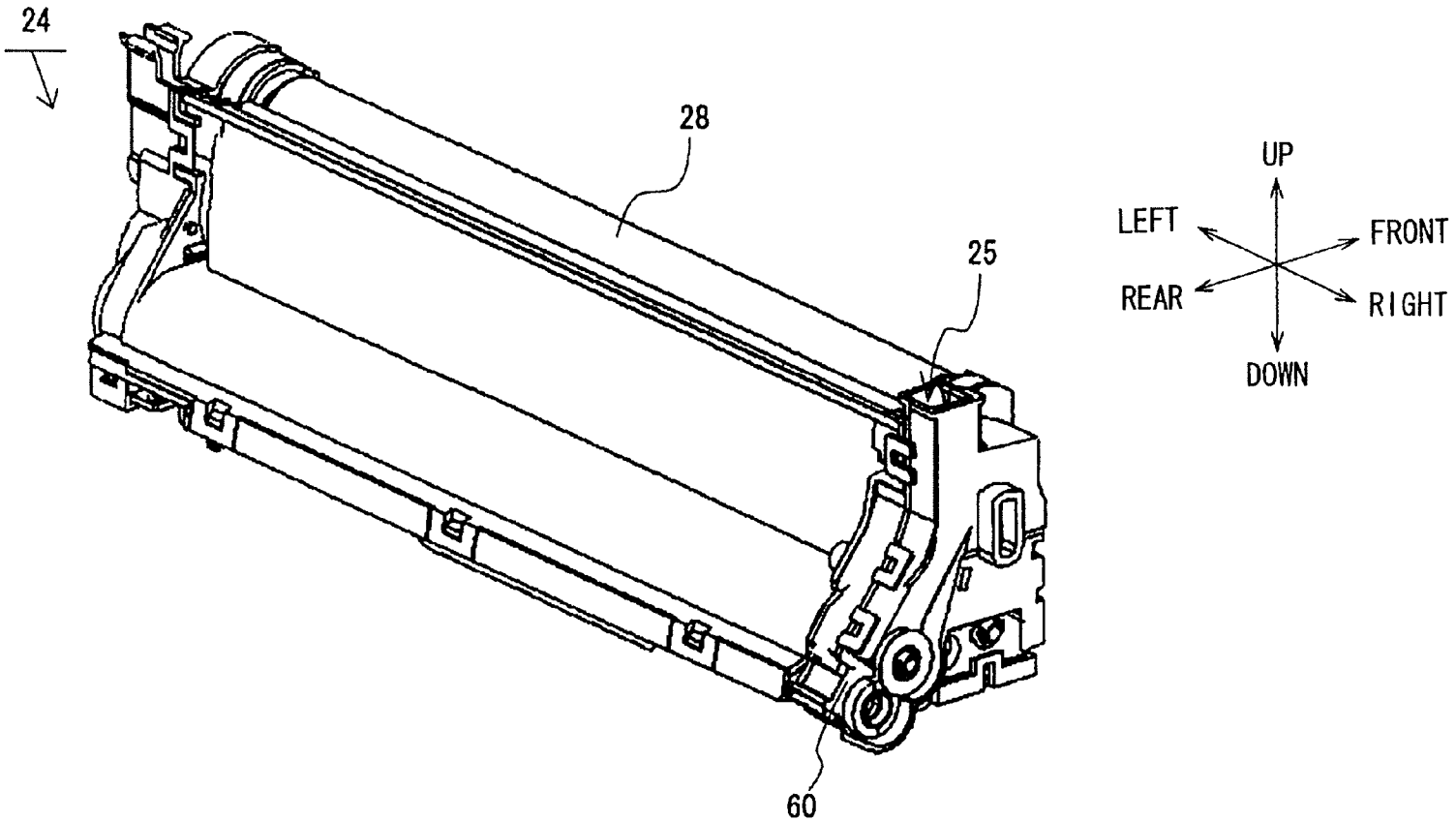
FIG. 3 is a perspective view of an entire development apparatus according to an embodiment of the present invention when seen from a rear-side and diagonally right upper position.
Figure 4A:
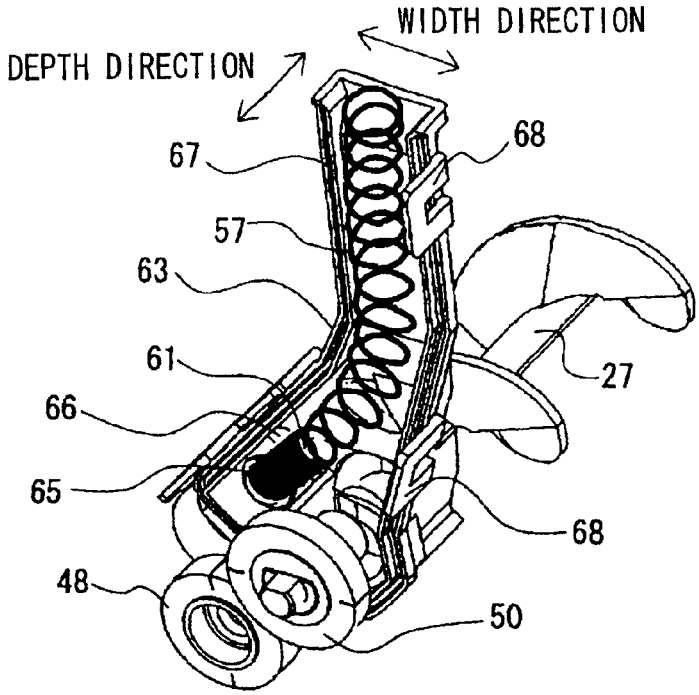
FIG. 4A is a perspective view showing an inside of a developer supply mechanism according to an embodiment of the present invention.
Figure 4B:
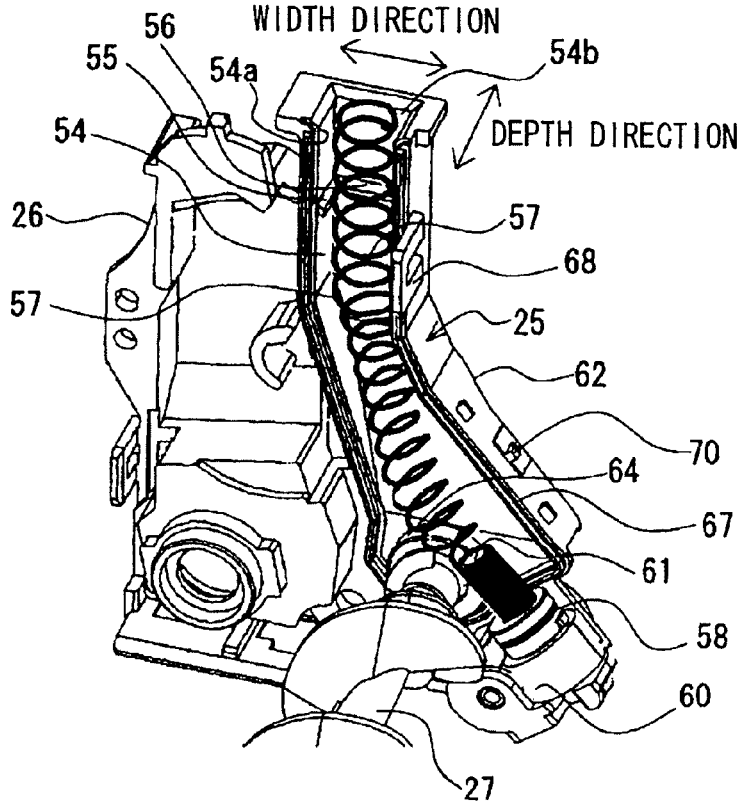
FIG. 4B is a perspective view showing the inside of the developer supply mechanism according to the embodiment of the present invention when seen from an inner-portion side of the development apparatus.

The developer supply mechanism 25 according to the embodiment of the present invention is described by using FIGS. 2 to 4B. FIG. 2 is a diagram showing a situation in which developer is carried from the black-toner container 40 to the developer supply mechanism 25. FIG. 3 is a perspective view of the entire development apparatus 24 when seen from a rear-side and diagonally upper position thereof. FIG. 4A is a perspective view showing an inside of the developer supply mechanism 25 when seen in a right-to-left direction shown in FIG. 3. FIG. 4B is a view showing the inside of the developer supply mechanism 25 when seen in a left-to-right direction shown in FIG. 3.

As shown in FIG. 2, developer supplied from the black-toner container 40 is supplied to a toner send portion 51 of the intermediate transfer unit 35. The developer supplied to the toner send portion 51 is sent by a developer carry spiral 52 to a vertical chute portion 53 that is situated over the developer supply mechanism 25. In the vertical chute portion 53, a shutter (not shown) that prevents leakage of the developer is mounted between the developer supply mechanism 25 and the vertical chute portion 53. When the shutter is opened, the developer is introduced into the developer supply mechanism 25 via the vertical chute portion 53.

Here, if the machine operates with the developer compressed to the vicinity of the shutter, a developer lump is introduced into the developer supply portion 25 when the shutter is opened.

Here, a case where the developer is supplied from the black-toner container 40 is supplied is described; however, because the developer is supplied from the other toner containers for three color toners, that is, the toner container 37 for magenta, the toner container 38 for cyan, and the toner container 39 for yellow in the same way, description of them is skipped.

As shown in FIG. 3, the developer supply mechanism 25 according to the embodiment of the present invention is situated to the right side of the development apparatus 24.

The developer supply mechanism 25 according to the embodiment of the present invention is described by using FIGS. 4A and 4B. The developer supply mechanism 25 includes: a developer supply path 54 that is opened upward into substantially a rectangular shape at one end side when seen in a planar fashion and guides developer in substantially a vertical direction; a first rib 55 (convex portion) that is formed on a wall surface 54*a* of the developer supply path 54; a second rib 56 that is formed on a wall surface 54*b* of the developer supply path 54 to be substantially perpendicular to the first rib 55; a coil spring 57 that is disposed in the developer supply path 54, stretchable and shrinkable in a longitudinal direction of the inside of the developer supply path 54; and a drive means that is connected to the coil spring 57 at the other end of the developer supply path 54 and rotates the coil spring 57 in a circumferential direction of the coil spring 57.

Hereinafter, each component of the developer supply mechanism 25 is described.

The drive means includes: a motor (not shown); a developer stir and carry spiral 27 that is rotated by the motor via a gear train (not shown); a worm (not shown) that is rotated by the developer stir and carry spiral 27; and a worm wheel 58 that is slowed down and rotated by the worm.

The developer stir and carry spiral 27 is disposed in the development apparatus 24, stirs and carries the developer introduced into the housing 26 of the development apparatus from one end side of the development apparatus 24 where there is the developer introduction opening to the other end side of the development apparatus 24.

The worm wheel 58 and the worm are situated below the developer supply path 54, mesh with each other and rotatably disposed in a worm gear case 60 that is unitarily formed with the housing 26 of the development apparatus 24. Here, a shaft 61 of the worm wheel 58 protrudes into the developer supply path 54. And, the worm is equipped with a spur gear 48 that rotates coaxially together with the worm.

The worm receives a drive force from a spur gear 50 that is coaxial with the developer stir and carry spiral 27 and rotates together with the developer stir and carry spiral 27. In other words, when the developer stir and carry spiral 27 receives the drive force from the motor via the gear train and rotates, the spur gear 50 on the coaxial shaft rotates. And, when the spur gear 50 of the developer stir and carry spiral 27 rotates, the spur gear 48 meshing with the spur gear 50 is rotated, so that the worm rotates. And, when the worm rotates, the worm wheel 58 that meshes with the worm is slowed down and rotated. The coil spring 57 is fitted to the shaft 61 of the worm wheel 57 and rotated.

Here, although an example of the drive means is described, this is not limiting: it is sufficient if the coil spring 57 is able to be rotated in a circumferential direction of the coil spring 57.

The developer supply path 54, as shown in FIGS. 4A and 4B, is opened upward to receive the developer. The developer supply path 54 is composed of: a developer-supply-path main body 62 that is divided in its longitudinal direction and is a detachable part which constitutes the outside of the development apparatus 24; and a developer-supply-path main body mount portion 63 that constitutes the developer supply path 54 in an inner portion of the development apparatus 24.

As shown in FIG. 4B, the developer-supply-path main body 62 has substantially an arc shape and constitutes the supply path for developer. And, in the developer-supply-path main body 62, a first rib 55 and a second rib 56 are formed at the same height positions in upper portions thereof; and the bearing 64 of the developer stir and carry spiral 27 is formed at a side-surface lower portion.

The developer-supply-path main body mount portion 63 has substantially an arc shape and constitutes the supply path for developer. And, in the developer-supply-path main body mount portion 63, a hole 65 is formed at a lower portion thereof to allow the shaft 61 of the worm wheel 58 to go through. Besides, the developer-supply-path main body mount portion 63 includes an opening 66 formed through a side-surface lower portion thereof to dispose one end side of the developer stir and carry spiral 27 in a lower portion of the inside of the developer supply path 54.

The developer-supply-path main body 62 and a side end portion 67 of the developer-supply-path main body mount portion 63 are so formed as to overlap each other when the developer-supply-path main body 62 is mounted on the developer-supply-path main body mount portion 63. And, on the outsides of the developer-supply-path main body 62 and the developer-supply-path main body mount portion 63, a hook portion 68 that is able to be elastically deformed and a projection portion 70 on which the hook portion 68 is hooked are formed.

The developer-supply-path main body 62 is connected to the developer-supply-path main body mount portion 63 with the side end portion 67 faced with the developer-supply-path main body 62, and the hook portion 68 is hooked on the projection portion 70, so that the developer supply path 54 is formed. The developer supply path 54 has substantially an arc shape. In other words, at the upper portion, the width and depth of the supply path are constant to have a square pipe shape, bends at around the central portion, and at the lower portion, the width becomes larger toward the downward portion.

The first rib 55 and the second rib 56 are unitarily formed with upper portions of the developer-supply-path main body 62. The first rib 55 is formed on the wall surface 54*b* that constitutes the depth of the developer supply path 54, that is, a surface to which the coil spring 57 is pressurized after the coil spring 57 is mounted, and substantially along the depth direction of the surface. The second rib 56 is formed on the wall surface 54*b* that constitutes the width of the developer supply path 54 and substantially along the width direction. The first rib 55 and the second rib 56 are formed at the same height positions and meet with each other at right angles. The first rib 55 and the second rib 56 each have a round shape at a tip end portion in a direction away from the wall. The first rib 55 and the second rib 56 are each able to hook the coil spring 57 between pitches; and comes off the coil spring 57 when some restoring force F acts downward from the coil spring 57.

The coil spring 57 is a compression coil spring that is wound clockwise (when seen from top). The shape of the coil spring 57 has a constant diameter and a constant pitch from an upper portion to a central portion. And, the pitch of the coil spring 57 is constant and the coil diameter becomes smaller from the central portion toward a lower portion. And, the lower portion has a constant coil diameter and no pitch to be substantially a cylindrical shape. This lower portion is fitted to the shaft 61 of the worm wheel 58.

The coil spring 57 is fitted to the shaft 61 of the worm wheel 58 and is able to rotate together with the shaft 61 of the worm wheel 58 in the circumferential direction of the coil spring 57. Here, because the coil spring 57 is disposed along the developer supply path 54, the coil spring 57 is disposed in a bent state. Here, the upper portion of the coil spring 57 is in a state to be pressurized to the wall surface 54*a* on which the first rib 55 is formed and to the wall surface 54*b* on which the second rib 56 is formed. And, the first rib 55 and the second rib 56 are situated between pitches of the coil spring 57. Accordingly, the coil spring 57 whose pitch of the upper portion is larger than at least a short-direction length of the rib is selected.

Besides, to allow the coil spring 57 to be hooked on the fist rib 55 and the second rib 56 after the coil spring 57 is disposed in the developer supply path 54, the coil spring 57 is designed in such a way that the upper end of the coil spring 57 is situated at a position higher than the first rib 55 and the second rib 56 in a natural-length state.

And, the outer diameter of the coil spring 57 is smaller than both of a value obtained by subtracting the height of the second rib 56 from the depth of the developer supply path 54 and a value obtained by subtracting the height of the first rib 55 from the width of the developer supply path 54. Here, the height of the first rib 55 and the height of the second rib 56 mean lengths in directions perpendicular to the wall surfaces 54*a*, 54*b* from the wall surfaces 54*a*, 54*b* on which the first rib 55 and the second rib 56 are formed, respectively. According to this, the coil spring 57 that is hooked on the first rib 55 and the second rib 56 inside the developer supply path 54 is able to come off the first rib 55 and the second rib 56 inside the developer supply path 54.

The coil spring 57 is designed in such a way that when the coil spring 57 rotates to the right (clockwise) inside the developer supply path 54 when seen from top, a spiral spring action portion of the coil spring 57 hooks on the first rib 55 to stretch upward.

Here, it is sufficient if the coil spring 57 is designed in such a way that after the coil spring is disposed in the developer supply path 54, the spiral spring action portion of the coil spring is able to be hooked on the first rib 55 and the second rib 56 in the natural-length state in which the spring is not stretched; and the coil spring is not limited to the above spring shape.

(Operation of the Developer Supply Mechanism 25)

Figure 5F:
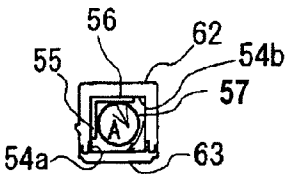
FIG. 5F is a plan view showing the opening portion of the developer supply path according to the embodiment of the present invention.
Figure 5E:
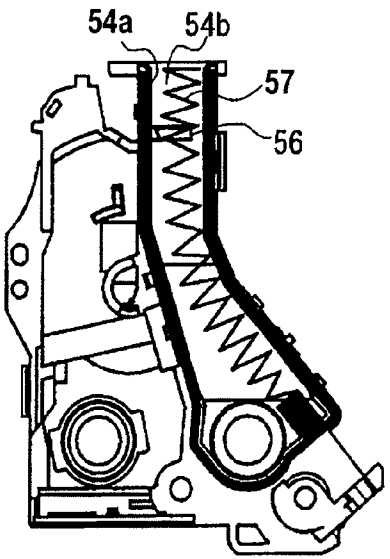
FIG. 5E is a side view showing a moment when the coil spring of the developer supply mechanism according to the embodiment of the present invention butts against a second rib.
Figure 5D:
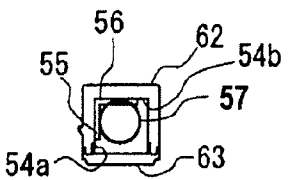
FIG. 5D is a plan view showing the opening portion of the developer supply path according to the embodiment of the present invention.
Figure 5C:
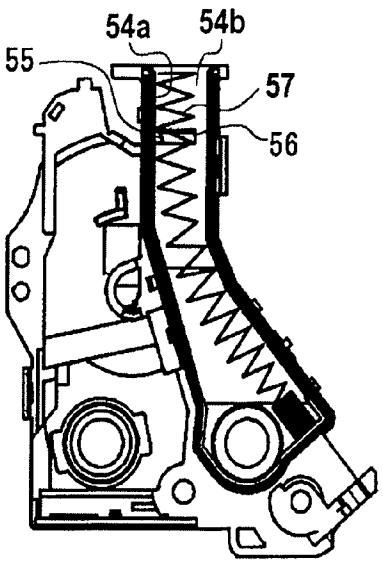
FIG. 5C is a diagram showing a moment when the coil spring of the developer supply mechanism according to the embodiment of the present invention comes off a first rib.
Figure 5B:
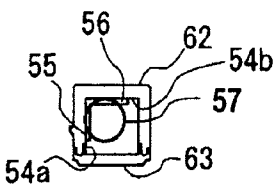
FIG. 5B is a plan view showing an opening portion of a developer supply path according to an embodiment of the present invention.
Figure 5A:
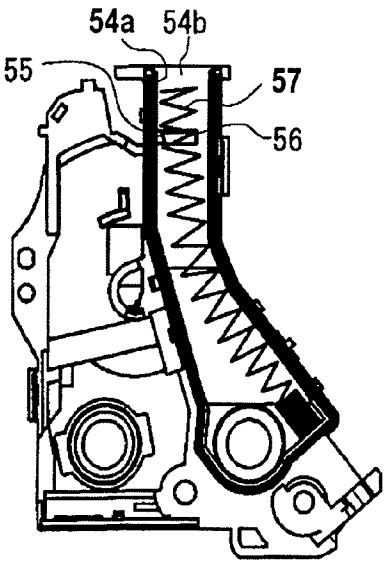
FIG. 5A is a diagram showing an initial state of a coil spring of the developer supply mechanism according to the embodiment of the present invention.
Figure 6A:
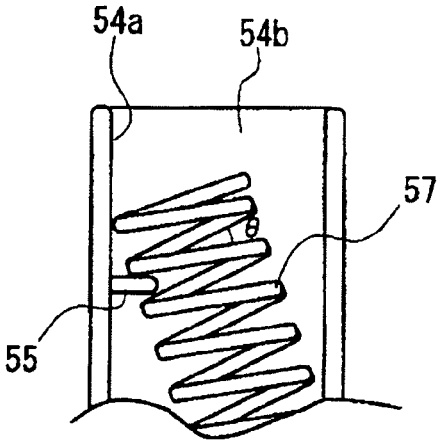
FIG. 6A is a diagram schematically showing a state in which the coil spring hooks on the first rib in an initial state in an embodiment of the present invention.
Figure 6B:
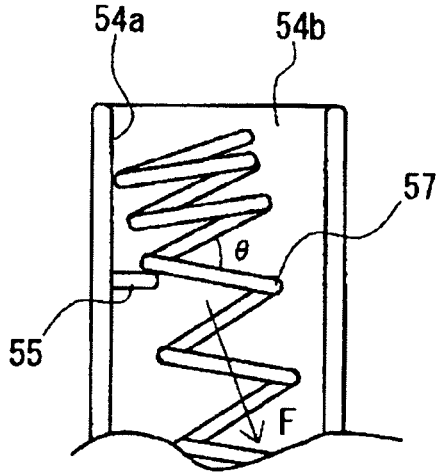
FIG. 6B is a diagram schematically showing a state in which the coil spring hooks on the first rib in a state in which the coil spring according to the embodiment of the present invention is stretched.
Figure 6C:
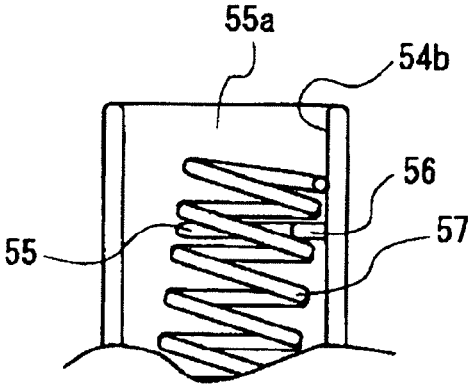
FIG. 6C is a diagram schematically showing, from another direction, the state in which the coil spring hooks on the first rib in the initial state in the embodiment of the present invention.

Operation of the developer supply mechanism 25 is described by using FIGS. 5A to 5F and FIGS. 6A to 6C. FIG. 5A is a diagram showing an initial state of the coil spring 57 of the developer supply mechanism 25. FIG. 5B is a plan view showing the opening portion of the developer supply path 54. FIG. 5C is a diagram showing a moment when the coil spring 57 of the developer supply mechanism 25 comes off the first rib 55. FIG. 5D is a plan view showing the opening portion of the developer supply path 54. FIG. 5E is a side view showing a moment when the coil spring 57 of the developer supply mechanism 25 butts against the second rib 56. FIG. 5F is a plan view showing the opening portion of the developer supply path 54. FIG. 6A is a diagram schematically showing a state in which the coil spring 57 hooks on the first rib 55 in the initial state. FIG. 6B is a diagram schematically showing a state in which the coil spring 57 hooks on the first rib 55 in a state in which the coil spring 57 is stretched. FIG. 6C is a diagram schematically showing, from another direction, the state in which the coil spring 57 hooks on the first rib 55 in the initial state.

FIG. 5A is a diagram of the developer supply mechanism 25 seen in a left-to-right direction in FIG. 3 and shows an initial state of the coil spring 57. FIG. 6A is a diagram of the coil spring 57 seen from the same direction in FIG. 5A, and, as shown in the figure, the coil spring 57 hooks on the first rib 55. In FIG. 6, the second rib 56 is not shown for convenience of the description. FIG. 5B is a plan view showing the opening portion of the developer supply path 54; the coil spring 57 is in contact with the wall surfaces 54*a*, 54*b* in the initial state. Here, as shown in FIG. 6C, because the coil spring 57 has the clockwise spiral shape, the coil spring 57 is not in contact with the second rib 56 that is formed at the same height position as the first rib 55 and is in a state in which the coil spring 57 and the second rib 56 have a gap therebetween. In this state, when the coil spring 57 is rotated clockwise, as shown in FIG. 6B, the coil spring 57 hooks on the first rib 55, so that the portion lower than the portion that hooks on the first rib 55 stretches downward. As the coil spring 57 stretches, the restoring force F of the coil spring 57 gradually increases and the pitch angle θ becomes larger, so that it becomes easy for the coil spring 57 to come off the first rib 55.

FIG. 5C is a diagram showing a moment when the coil spring is rotated and the coil spring 57 comes off the first rib 55. FIG. 5D is a plan view showing a moment when the coil spring 57 comes off the first rib. In this state, when the coil spring 57 is further rotated, the coil spring 57 slides off the first rib 55 with the aid of the restoring force F that acts downward. In other words, the coil spring 57 is given a horizontal-direction movement to leave the wall surface 54*a* on which the first rib is formed.

And, when the coil spring 57 comes off the first rib 55, the coil spring 57 shrinks with the aid of the restoring force F. Because of this, the coil spring 57 butts against the second rib 56.

FIG. 5E is a view showing a moment when the coil spring 57 butts against the second rib 56. Here, the coil spring 57 shrinks with the aid of the restoring force F and the spiral of the coil spring 57 and the second rib 56 butt against each other. Because the coil spring 57 butts at the spiral portion, the coil spring 57 is bounced back in an A direction in FIG. 5F by the second rib 56. In other words, a horizontal-direction movement is given to the upper portion of the coil spring 57.

Accordingly, after the coil spring 57 is bounced back by the second rib 56, force that moves the coil spring 57 in the arrow A direction, force that restores the coil spring 57 to the original length, and force that is given from the initial state and pressurizes the coil spring 57 to the wall surface 54*a* on which the first rib 55 is formed and to the wall surface 54*b* on which the second rib 56 is formed act on the coil spring 57. As a result of this, the coil spring 57 moves along a nearly circular locus as shown in FIG. 5F inside the developer supply path 54 and returns to the state shown in FIGS. 5A, 5B and 6A. Here, the coil spring 57 butts against the wall surfaces 54*a* and 54*b* to generate a small vibration in the developer supply path 54.

And, the coil spring 57 that returns to the initial state repeats a series of operations in which the coil spring 57 hooks on the first rib 55, stretches again, comes off the first rib 55, and is bounced back by the second rib 56.

The above developer supply mechanism 25 breaks down the developer that is introduced inside the developer supply path 54 by using the coil spring 57 that performs the above operation, and makes the developer fall onto the developer stir and carry spiral 27.

Here, when the coil spring 57 returns to the initial state, the coil spring 57 butts against the wall surface to generate a small vibration; however, this small vibration is not so large as to influence the development; the magnitude of the vibration is designed to be the optimum value based on the winding pitch, line shape and the like of the coil spring 57.

Besides, in this embodiment, the winding pitch, line shape and natural length of the coil spring 57 are suitably designed in such a way that the coil spring 57 does not jump out of the developer supply path 54 in the longest-stretched state, because this is to prevent the coil spring 57 from being caught by the shutter of the vertical chute portion 53.

(Effects of the Developer Supply Mechanism)

The coil spring 57 performs periodically the above vertical movement and substantially the circular movement inside the developer supply path 54, so that the breakdown effect of the falling developer increases. And, in this series of operations, the coil spring 57 butts against the wall surfaces 54*a* and 54*b*, thereby giving the small vibration to the wall surfaces and making the developer adhering to the wall surfaces fall. According to this, it is possible to supply more stable developer compared with the structure that does not have the developer supply mechanism 25.

(Modifications)

Figure 7A:
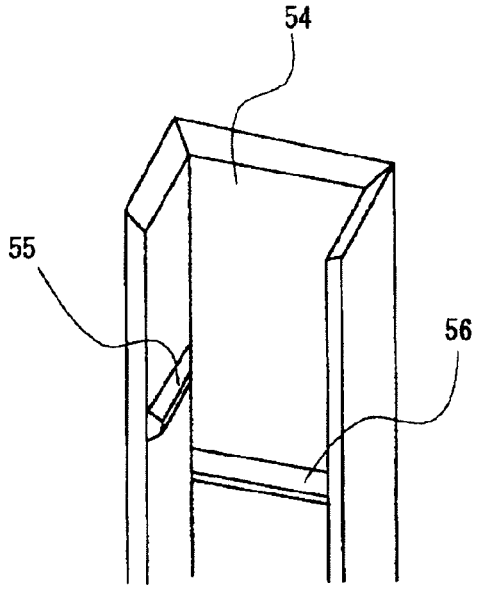
FIG. 7A is a diagram showing a modification in which the first rib and the second rib according the embodiment of the present invention are disposed at positions different from each other in a height direction.
Figure 7B:
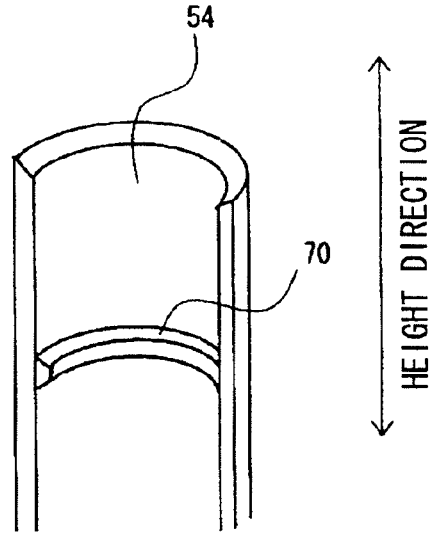
FIG. 7B is a diagram showing a modification in which a rib is formed in a cylindrical developer supply path according to an embodiment of the present invention.
Figure 8:
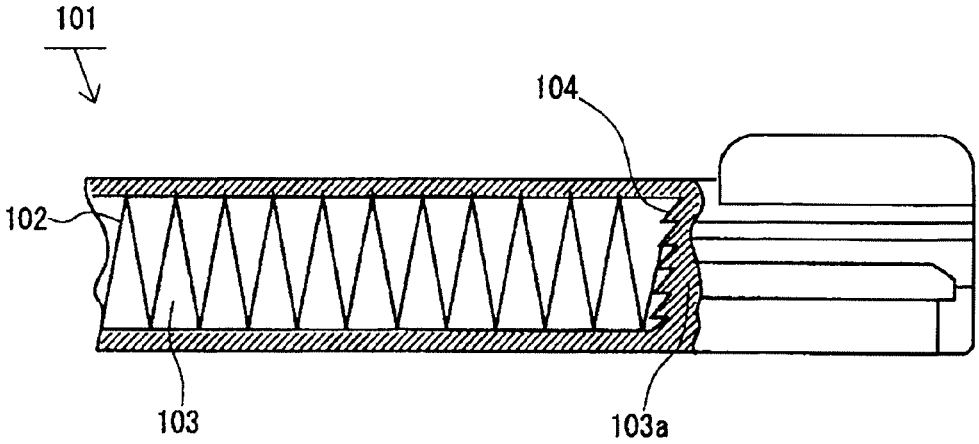
FIG. 8 is a diagram showing a toner supply apparatus described as a related art.

Modifications of the rib formed in the developer supply path 54 are described with reference to FIGS. 7A and 7B. FIG. 7A is a diagram showing a modification in which the first rib 55 and the second rib 56 are disposed at positions different from each other in the height direction. FIG. 7B is a diagram showing a modification in which the rib is formed in the development supply path 54 that is cylindrical.

In the modification shown in FIG. 7A, the first rib 55 and the second rib 56 are formed at positions different from each other in the height direction. If the first rib 55 and the second rib 56 are formed to be connected to each other, the developer is likely to collect on a corner of the rib in the developer supply path 54; however, if the ribs are formed at different positions, an effect is obtained, in which the developer is unlikely to collect on the corner of the rib in the developer supply path 54 compared with the structure in which the first rib 55 and the second rib 56 are formed at the same height.

In the modification shown in FIG. 7B, the developer supply path 54 has a cylindrical shape, and an arc-shape rib 70 is formed on the inner wall and substantially perpendicularly to the height direction. Because the arc-shape rib 70 is formed and bent along a circumferential direction of the inner wall of the cylinder, the rib is able to perform the functions of the above first rib 55 and the second rib 56. Further, the arc-shape rib 70 may be formed to be round at its tip end portion in a direction away from the wall.

Here, although the rib is unitarily formed with the inside of the developer supply path 54, this is not limiting: the rib may be mounted later as a separate part.

The present invention is summed up from each embodiment as follows. In other words, a developer supply mechanism according to an embodiment of the present invention is structured to include: a developer supply path one end side of which is opened outward and which guides the developer in substantially a vertical direction; a convex portion that is formed on a wall surface of the developer supply path; a coil spring that is disposed in the developer supply path, stretchable and shrinkable in a longitudinal direction of the developer supply path, pressurized to the convex portion in a natural-length state, stretched toward one end side of the developer supply path when the convex portion is hooked on between pitches by a circumferential-direction rotation, and is given a horizontal-direction movement to leave the convex portion when coming off the convex portion; and a drive portion that is connected to the coil spring at the other end side of the developer supply path and rotates the coil spring in the circumferential direction of the coil spring.

According to this structure, because the coil spring not only performs a vertical movement rotating in the developer supply path but also moves in a horizontal direction, the breakdown effect of falling developer increases. Accordingly, it is possible to send stable developer to a development apparatus.

Besides, in the developer supply mechanism according to an embodiment of the present invention, it is desirable that a sectional shape of the developer supply path when seen in a planar fashion is substantially a rectangular shape; and the convex portion includes: a first rib that is formed along a circumferential direction of the coil spring and on one of wall surfaces; and a second rib that is formed along the circumferential direction of the coil spring and on one of wall surfaces adjacent to the wall on which the first rib is formed.

According to this structure, when the coil spring is rotated clockwise, the coil spring comes off the first rib, and the coil spring is given a horizontal-direction movement to leave the wall surface on which the first rib is formed. Further, when the coil spring comes off the first rib, the coil spring butts against the second rib. Because the coil spring butts at the spiral portion, the coil spring is bounced back by the second rib. In other words, it is possible to obtain an effect that a horizontal-direction movement is given to the upper portion of the coil spring.

Besides, in the developer supply mechanism according to an embodiment of the present invention, it is desirable that the first rib and the second rib each have a round shape at a tip end portion in a direction away from the wall surface.

According to this structure, in performing repeatedly a series of operations that the coil spring hooks on the first rib, stretches again, comes off the first rib, and is bounced back by the second rib, it is possible to obtain an effect that the series of operations are performed smoothly.

Besides, in the developer supply mechanism according to an embodiment of the present invention, it is possible to employ a structure in which the first rib and the second rib are formed at the same height positions and meet with each other at right angles.

According to this structure, it is possible to surely obtain an operation that the coil spring comes off the first rib and is given a horizontal-direction movement and an effect that the coil spring butts against the second rib, is bounced back by the second rib, and the given horizontal-direction movement.

Besides, in the developer supply mechanism according to an embodiment of the present invention, the first rib and the second rib are formed at positions different from each other in a height direction.

According to this structure, it is possible to obtain an effect that the developer is unlikely to collect on a corner of the rib in the developer supply path compared with the structure in which the first rib and the second rib are formed at the same height.

Besides, in the developer supply mechanism according to an embodiment of the present invention, a structure may be employed, in which the developer supply path has a cylindrical shape; and the convex portion includes an arc-shape rib that is formed on an inner wall of the developer supply path and perpendicularly to a height direction.

Besides, in the developer supply mechanism according to an embodiment of the present invention, it is desirable that the arc-shape rib has a round shape at a tip end portion in a direction away from the wall.

According to this structure, a series of operations are performed repeatedly, in which the coil spring hooks on the first rib, stretches again, comes off the first rib, and is bounced back by the second rib, so that it is possible to obtain an effect that the series of operations are performed smoothly.

Besides, in the developer supply mechanism according to an embodiment of the present invention, it is desirable that the developer supply path has substantially an arc shape.

Besides, the development apparatus according to an embodiment of the present invention is a development apparatus for developing an electrostatic latent image that is formed on a surface of an image carrier, and has a structure to include the above developer supply mechanism.

Besides, the image forming apparatus has a structure to include: the above development apparatus; an image carrier on which an electrostatic image is made visible by the development apparatus as a toner image; and a transfer portion that transfers the toner image on the image carrier onto a recording material.

The developer supply mechanism according to the present invention is widely applicable to a supply path for developer in which the developer is moved in substantially a vertical direction and supplied to a development apparatus.

What is claimed is:

1. A developer supply mechanism, comprising:

a developer supply path one end side of which is opened upward and which guides the developer in substantially a vertical direction;

a convex portion that is formed on a wall surface of the developer supply path;

a coil spring that is disposed in the developer supply path, stretchable and shrinkable in a longitudinal direction of the developer supply path, pressurized to the convex portion in a natural-length state, stretched toward one end side of the developer supply path when the convex portion is hooked on between pitches by a circumferential-direction rotation, and is given a horizontal-direction movement to leave the convex portion when coming off the convex portion; and a drive portion that is connected to the coil spring at the other end side of the developer supply path and rotates the coil spring in the circumferential direction of the coil spring.

2. The developer supply mechanism according to claim 1, wherein a sectional shape of the developer supply path when seen in a planar fashion is substantially a rectangular shape; and the convex portion includes: a first rib that is formed along the circumferential direction of the coil spring and on one of wall surfaces; and a second rib that is formed along the circumferential direction of the coil spring and on one of wall surfaces adjacent to the wall on which the first rib is formed.

3. The developer supply mechanism according to claim 2, wherein the first rib and the second rib each have a round shape at a tip end portion in a direction away from the wall.

4. The developer supply mechanism according to claim 2, wherein the first rib and the second rib are formed at same height positions and meet with each other at right angles.

5. The developer supply mechanism according to claim 2, wherein the first rib and the second rib are formed at positions different from each other in a height direction.

6. The developer supply mechanism according to claim 1, wherein the developer supply path has a cylindrical shape; and the convex portion includes an arc-shape rib that is formed on an inner wall of the developer supply path and perpendicularly to a height direction.

7. The developer supply mechanism according to claim 6, wherein the arc-shape rib has a round shape at a tip end portion in a direction away from the wall.

8. The developer supply mechanism according to claim 1, wherein the developer supply path has substantially an arc shape.

9. A development apparatus for developing an electrostatic latent image that is formed on a surface of an image carrier, comprising the developer supply mechanism described in claim 1.

10. An image forming apparatus, comprising:

the development apparatus described in claim 9;

an image carrier on which an electrostatic image is made visible by the development apparatus as a toner image; and a transfer portion that transfers the toner image on the image carrier onto a recording material.

* * * * *